US006659051B2

(12) United States Patent
Shiomi et al.

(10) Patent No.: US 6,659,051 B2
(45) Date of Patent: Dec. 9, 2003

(54) OIL-COOLED ENGINE ASSEMBLY

(75) Inventors: Kazuyuki Shiomi, Wako (JP); Tamotsu Momosaki, Wako (JP); Haruhiko Ohkawa, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/005,719

(22) Filed: Nov. 8, 2001

(65) Prior Publication Data

US 2002/0040694 A1 Apr. 11, 2002

(30) Foreign Application Priority Data

Nov. 10, 2000 (JP) ..... 2000-344469

(51) Int. Cl.[7] ..... F01P 3/00
(52) U.S. Cl. ..... 123/41.42; 123/196 AB
(58) Field of Search ..... 123/41.42, 41.57, 123/41.33, 196 R, 196 AB, 195 R; 184/104.2, 104.3; 180/229

(56) References Cited

U.S. PATENT DOCUMENTS 3,945,463 A * 3/1976 Okano et al. ..... 184/6.13
4,174,482 A 11/1979 Bollman ..... 290/1 A
4,690,236 A * 9/1987 Shinozaki et al. ..... 180/219
5,031,580 A * 7/1991 Takagi et al. ..... 123/41.42
5,458,101 A * 10/1995 Crooks ..... 123/196 S
6,058,898 A * 5/2000 Freese

FOREIGN PATENT DOCUMENTS

EP 0396939 11/1990
JP 03-067011 3/1991

* cited by examiner

*Primary Examiner*—Mahmoud Gimie
(74) *Attorney, Agent, or Firm*—Adams & Wilks

(57) ABSTRACT

An oil-cooled engine assembly is provided for cooling lubricating oil, which has lubricated movable parts of an engine and subsequently recirculating cooled lubricating oil to the movable parts. The engine assembly includes a lubricating oil pump contained in the engine, and a hollow frame body which supports the engine. The hollow frame body has an oil passage through which lubricating oil flows. The lubricating oil pump is connected to the oil passage. Lubricating oil, which has lubricated the movable parts of the engine is air cooled with the frame body. Cooled lubricating oil is circulated again to the movable parts of the engine.

13 Claims, 7 Drawing Sheets

OIL-COOLED ENGINE ASSEMBLY

FIELD OF THE INVENTION

The present invention relates to an oil-cooled engine assembly in which after lubricating movable parts of an engine, a lubricating oil is cooled and then returned to circulation for cooling the movable parts again.

BACKGROUND OF THE INVENTION

In an engine, rotating parts such as a crank shaft and bearings of a connecting rod and sliding parts (hereinafter referred to as movable parts) operate at a high temperature due to friction. The movable parts, which remain at a high temperature, are cooled by lubrication with a lubricating oil. Cooling of the lubricating oil after lubrication may be performed by connecting a lubrication line, which includes an oil cooler and an oil tank, to the engine for circulating the lubricating oil. However, there is a need for a space to locate the oil cooler and the oil tank. In order to achieve miniaturization of a whole structure of the oil-cooled engine assembly including the lubrication line, there is yet room for structural improvement.

The engine assembly, which is arranged to reduce an occupying space of the oil tank, has been proposed in, for example, Japanese Patent Publication No. SHO-63-67077 entitled "Engine Mounting Assembly" and Japanese Patent Laid-Open Publication No. HEI-3-67011 entitled "Oil Supply Structure For Engine".

The engine assembly disclosed in Japanese Patent Publication No. SHO-63-67077 is comprised of a mounting base, made of a steel tube which supports the engine, in which the oil tank is formed to be filled with a lubricating oil which is circulated with a first engine-drive pump driven with the engine. That is, the mounting base also plays the oil tank role.

However, the mounting base of the engine assembly forms a member for supporting the engine, causing a restriction in size by itself. Accordingly, a limitation arises in freely determining a capacity for which the oil tank occupies. The presence of the mounting base made from steel tube seems to have more or less effect for dissipating heat of lubricating oil in the oil tank. But, the presence of restriction in the size of the mounting base encounters the limitation in enhancing an adequate heat dissipating area.

The engine assembly disclosed in Japanese Patent Laid-Open Publication No. HEI-3-67011 has a structure wherein a cylinder block of the engine is formed with an oil tank at an outer periphery of a water jacket to contain the oil tank within the cylinder block. Lubricating oil is cooled with coolant water in the water jacket.

However, a functional restriction is encountered in the engine in terms of a shape and a dimension of the cylinder block in the engine assembly. The presence of the oil tank contained in such a cylinder block undergoes a limitation in enhancing an adequate capacity for the oil tank and an adequate heat dissipating area for the oil cooler.

SUMMARY OF THE INVENTION

It is therefore an object of the present invention to provide an engine assembly which enables a capacity for storing a lubricating oil and a heat dissipating area for cooling lubricating oil to be adequately obtained while achieving the miniaturization of the oil-cooled engine assembly per se.

According to an aspect of the present invention, there is provided an oil-cooled engine assembly which comprises:

an engine; a lubricating oil pump disposed internally of the engine; and a hollow frame body which surrounds the engine and engine accessories including a carburetor and a muffler, supports the engine, and is internally formed with an oil passage through which lubricating oil flows. The lubricating oil pump is connected to the oil passage to allow the lubricating oil, which has lubricated movable parts of the engine, to be air cooled with the frame body. The cooled lubricating oil is subsequently recirculated to the movable parts of the engine.

Since the frame body, which supports the engine, is arranged to surround the engine and the engine accessories, the frame body has an increased total length. The adoption of the hollow frame body allows the frame body to serve as the oil passage through which lubricating oil flows to be air cooled. The increased total length of the frame body results in an increase in a heat dissipating area. Thus, the frame body provides an increased heat dissipating effect. In such a manner, the frame body, which supports the engine, also plays a role as the oil tank and oil cooler, resulting in no need for separately providing the oil cooler and the oil tank to achieve a miniaturization of the whole structure of the engine assembly. In addition, the engine is ranged to incorporate therein the lubricating oil pump. This precludes the lubricating oil pump from protruding from the engine.

Desirably, the carburetor is located at one side of the engine and the aforementioned muffler is located at the other side of the engine. It is desired that a lubricating oil supply conduit is additionally provided for supplying lubricating oil from the frame body component, in the vicinity of the crank chamber of the engine to the lubricating oil pump. Lubricating oil, which is cooled with the frame body, is supplied from the frame body component, which is close proximity to the crank chamber remaining at a lower temperature than the frame body component closer to the muffler, to the lubricating pump. The presence of the lubricating oil return conduit connected to the frame body at a point remote from the high temperature muffler provides no fear of lubricating oil being exposed to a high temperature.

In a preferred form, the frame body is covered with the plurality of cover plates having heat dissipating properties, one of which has an air intake port to allow the cooling fan, which draws outside air from the air intake port, to be mounted to the crank shaft. The plurality of cover plates to be mounted to the frame body serves as respective heat discharging plates. Thermal heat produced by the frame body is dissipated via the plurality of cover plates. Since the plurality of cover plates surround a periphery of the frame body, an increased heat dissipating area is obtained. This results in an increase in cooling efficiency for cooling lubricating oil. Also, inner surfaces of the plurality of cover plates and the surface of the frame body covered with the plurality of cover plates are cooled with outside air drawn by the cooling fan. Thus, the heat dissipating performance of the frame body is further improved. In addition, the presence of the plurality of cover plates to cover the frame body allows the engine and the engine accessories to be concealed, resulting in a reduction in engine noise.

In the engine assembly of the present invention, the power output shaft is detachably connected to the crank shaft of the engine and is rotatably supported with either one of the frame body and the cover plates. It is possible for the power output shaft to be altered according to a kind of load to be driven with the engine. Consequently, there is no need for the crank shaft to be altered in accordance with the load.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
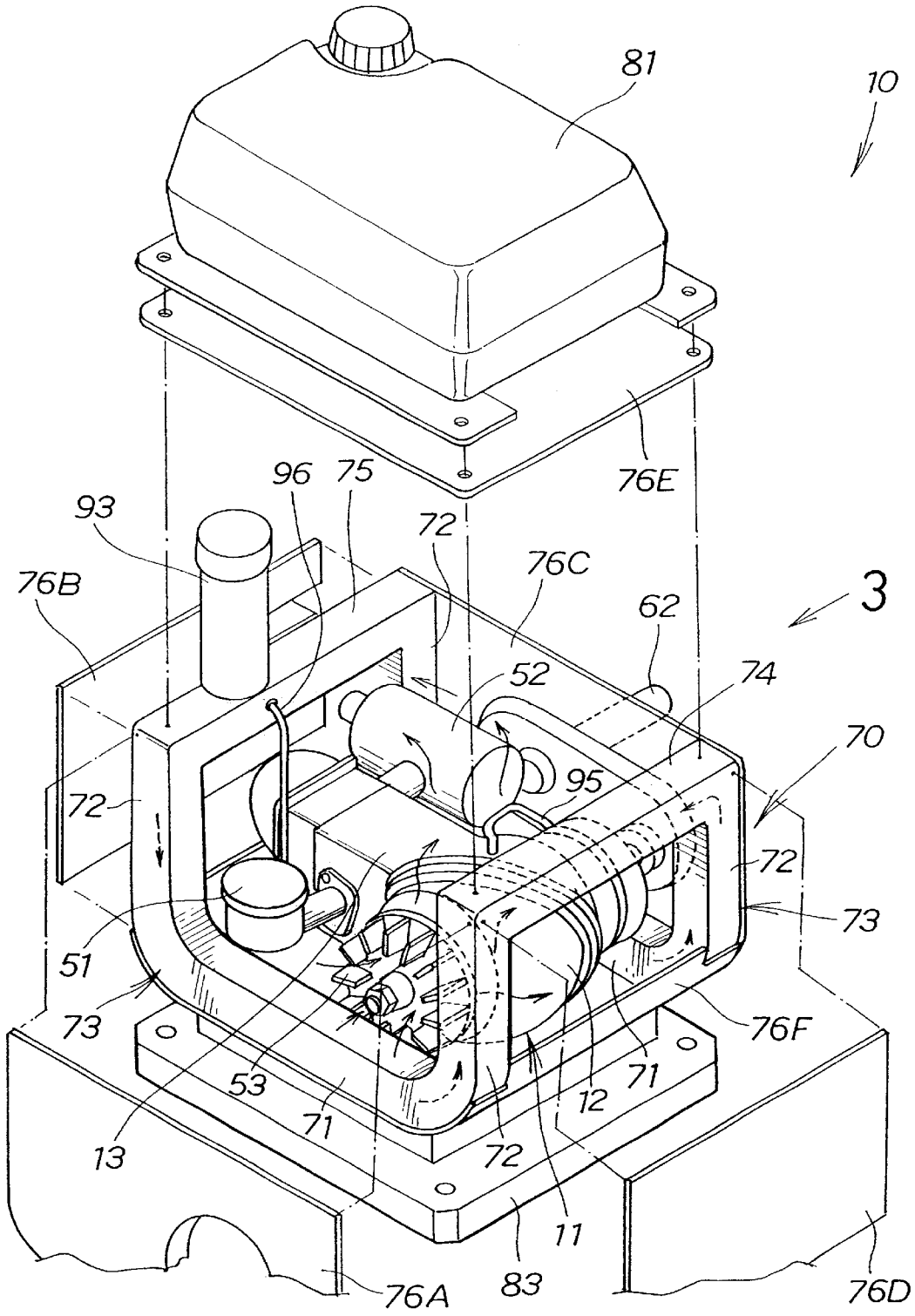
FIG. 1 is a perspective view of an oil-cooled engine assembly according to the present invention.

In FIG. 1, an oil-cooled engine assembly 10 is constructed of a hollow frame body 70 which surrounds an engine 11 and engine accessories (a carburetor 51 and a muffler 52, etc.) and which supports the engine 11. A circumferential periphery of the hollow frame body 70 has a plurality of cover plates 76A to 76F, which conceal the frame body 70.

The engine 11 includes a cylinder block 13 which is located in a horizontal direction and has one side (as viewed left side) located with a carburetor 51 and the other side (as viewed right side) located with the muffler 52.

The frame body 70 includes upwardly opening U-shaped frame components 73, 73, formed by two upright portions 72, 72 extending upward from both longitudinal ends of respective horizontal portions 71, 71, which are located at both left and right sides of the engine 11. Among the left and right frame components 73, 73, one pair of the upright portions 72, 72, which stand upright in one opposed relationship, and the other pair of the upright portions 72, 72, which stands upright in another opposed relationship, are mutually connected at their upper distal ends to one another by means of horizontal connecting portions (a first connecting portion 74 and a second connecting portion 75), respectively, which are made of rectangular or round pipe materials.

The frame body 70 and the plurality of cover plates 76A to 76F are made of materials having an excellent thermal conductivity to provide a heat dissipating property, such as, for example, aluminum or aluminum alloy.

The first and second connecting portions 74, 75 carry thereon a cover plate 76E, which covers an upper area of the frame body 70 and supports a fuel tank 81.

Also, among the plurality of cover plates 76A to 76F, the left and right side cover plates 76A, 76C are unitarily shaped to form one set, and the fore and aft side cover plates 76B, 76D and the ceiling cover plate 76E are unitarily shaped to form another one set, with two sets of the cover plates being assembled to surround the frame body 70.

Figure 2:
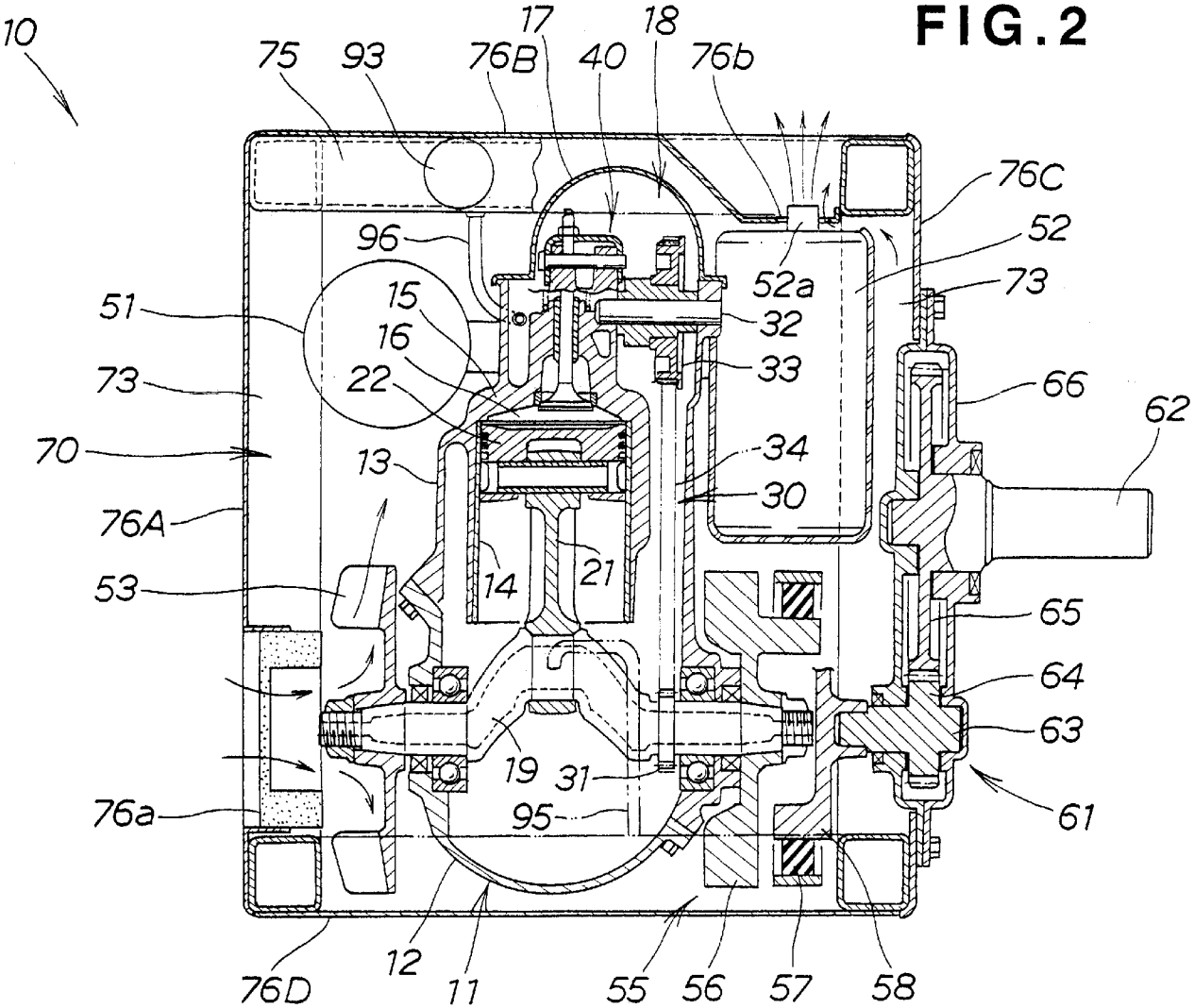
FIG. 2 is a horizontal cross-sectional view of the oil-cooled engine assembly shown in FIG. 1.

FIG. 2 is a horizontal cross sectional view of the oil-cooled engine assembly shown in FIG. 1.

The engine 11, shown in FIG. 2, is a general-purpose engine of a four-cycle single cylinder adopting OHC (overhead cam) type and is of a high speed engine with a crank shaft 19 which is preselected to rotate at 12,000 rpm. In particular, the engine 11 is constructed of a main structure including a crank case 12, the cylinder block 13, a head cover 17, the crank shaft 19, a connecting rod 21, a piston 22, a power transmission mechanism 30 and a valve actuating mechanism 40.

The crank case 12 is coupled to the cylinder block 13 by bolts. The cylinder block 13 is internally formed with a cylinder 14 and a distal end of the cylinder block 13 is integrally formed with a cylinder head 15. A combustion chamber 16 is formed between a distal end of the cylinder 14 and the cylinder head 15.

The crank shaft 19 is connected through the connecting rod 21 to the piston 22 which is slidably received in the cylinder 14 for reciprocating movement.

FIG. 2 illustrates a valve actuating chamber 18 which is formed with the cylinder head 15 and the head cover 17 by coupling a distal end of the cylinder head 15 to the head cover 17 by bolts and which accommodates therein the valve actuating mechanism 40.

The power transmission mechanism 30 includes a drive pulley 31 mounted to the crank shaft 19 in the crank case 12, a driven pulley 33 mounted to a cam shaft 32, and a timing belt 34 streched across the drive pulley 31 and the driven pulley 33. Since a space defined between the crank case 12 and the cylinder block 13 contains the power transmission mechanism 30, the power transmission mechanism 30 can be minimized in structure.

A cooling fan 53 is mounted to one end of the crank shaft 19. Among the plurality of cover plates 76A to 76F, an air intake port 76*a* is formed at a position facing an air intake side of the cooling fan 53 to allow outside air to be drawn through the air intake port 76*a* by means of the cooling fan 53. The outside air, which is drawn, flows through paths along internal surfaces of the plurality of cover plates 76A to 76F and the frame body 70 concealed with the plurality of cover plates 76A to 76F and is discharged to the atmosphere through an exhaust port 76*b* formed near the side of the muffler 52. In such a manner, the internal surfaces of the plurality of cover plates 76A to 76F and a surface of the frame body 70 concealed with the cover plates 76A to 76F are cooled with outside air drawn by the cooling fan 53. Consequently, it is possible for the plurality of cover plates 76A to 76F and the frame body 70 to be cooled at an increased efficiency.

Further, since the exhaust gas outlet 52*a* of the muffler 52 is located at a position where the exhaust port 76*b* is located, engine exhaust gases emitted from the muffler 52 are combined with a stream of the outside air drawn by the cooling fan 53 to be discharged the outside of the plurality of cover plates 76A to 76F.

The presence of the frame body with its circumferential periphery mounted with the plurality of cover plates 76A to 76F having the respective heat dissipating properties, that is, the presence of the frame body concealed with the plurality of cover plates 76A to 76F, enables heat dissipated from the frame body 70 to be discharged via the plurality of cover plates 76A to 76F. Since the plurality of cover plates 76A to 76F conceals the circumferential periphery of the frame body 70, the heat dissipating effective surface area is extremely increased. Thus, the plurality of cover plates 76A to 76F having the large heat dissipating surface areas provide an increased heat dissipating effect. Accordingly, it is possible for a cooling efficiency for cooling lubricating oil to be highly improved.

In addition, covering the frame body 70 with the plurality of cover plates 76A to 76F enables the engine 11 and the engine accessories (the carburetor 51 and the muffler 52, etc.) to be concealed. Accordingly, engine noise can be eliminated.

The other end of the crank shaft 19 is detachably coupled through a displacement absorbing coupling 55, which is called a float coupling, and a reduction gear mechanism 61 to a power output shaft 62. The displacement absorbing coupling 55 is composed of a combined structure including a first coupling member 56 connected to the crank shaft 19, and a second coupling member 58 connected to the first coupling member 56 via a plurality of resilient members 57. Such a displacement absorbing coupling is a well known coupling as disclosed in, for example, Japanese Patent Provisional Publication No. 6-26550 entitled "Vibration-Proof Engine Bed".

The provision of the displacement absorbing coupling 55 allows vibrations of the engine 11 to be absorbed with the plurality of resilient members 57 for precluding vibrations from being transferred to the gear reduction unit 61 and the power output shaft 62. Thus, the gear reduction mechanism 61 is precluded to generate noises due to vibrations of the engine 11, while precluding vibrations of the engine 11 from being transferred to load via the power output shaft 62.

The gear reduction mechanism 61 serves to reduce the rotational speed of the crank shaft 19 to a desired rotating speed at which the power output shaft 62 is rotated and is composed of a gear type reduction mechanism including an intermediate shaft 63 coupled to the second coupling member 58, a drive gear 64 formed at the intermediate shaft 63, a driven gear 65 formed on the power output shaft 62 to mesh with the drive gear 64, and a gear case 66 which accommodates therein the drive gear 64 and the driven gear 65. The gear case 66 is mounted to the frame body 70 by fixedly securing the gear case 66 to the cover plate 76C such that the power output shaft 62 is rotatably supported.

Removing the gear case 66 from the cover plate 76C enables the gear reduction mechanism 61 to be removed from the crank shaft 19. Also, disassembling the gear case 66 enables the power output shaft 62 to be removed from the gear reduction mechanism 61. In such a manner, it is possible for the power output shaft 62 to be rotatably supported with the frame body 70 or the cover plate 76C.

The presence of the power output shaft 62 detachably connected to the crank shaft 19 and rotatably supported with the frame body 70 or the cover plate 76C enables the power output shaft 62 to be altered according to a kind of loads which the engine 11 drives. Accordingly, there is no need for the crank shaft 19 to be altered in dependence on the load, with a resultant increase in the productivity of the crank shaft 19 with an increased favorable effect in distribution, assembly and manufacturing cost.

As shown in FIG. 2, forming surfaces of the crank case 12 and the cylinder block 13 in a spherical shape enables a sound radiated in the engine 11 to be eliminated.

The cooling fan 53 and the first coupling member 56, which are located outside the crank case 12, may play a counter-weight role of the crank shaft 19. Also, the crank shaft 19 is hollowed. Thus, the crank shaft 19 may be reduced in weight.

Figure 3:
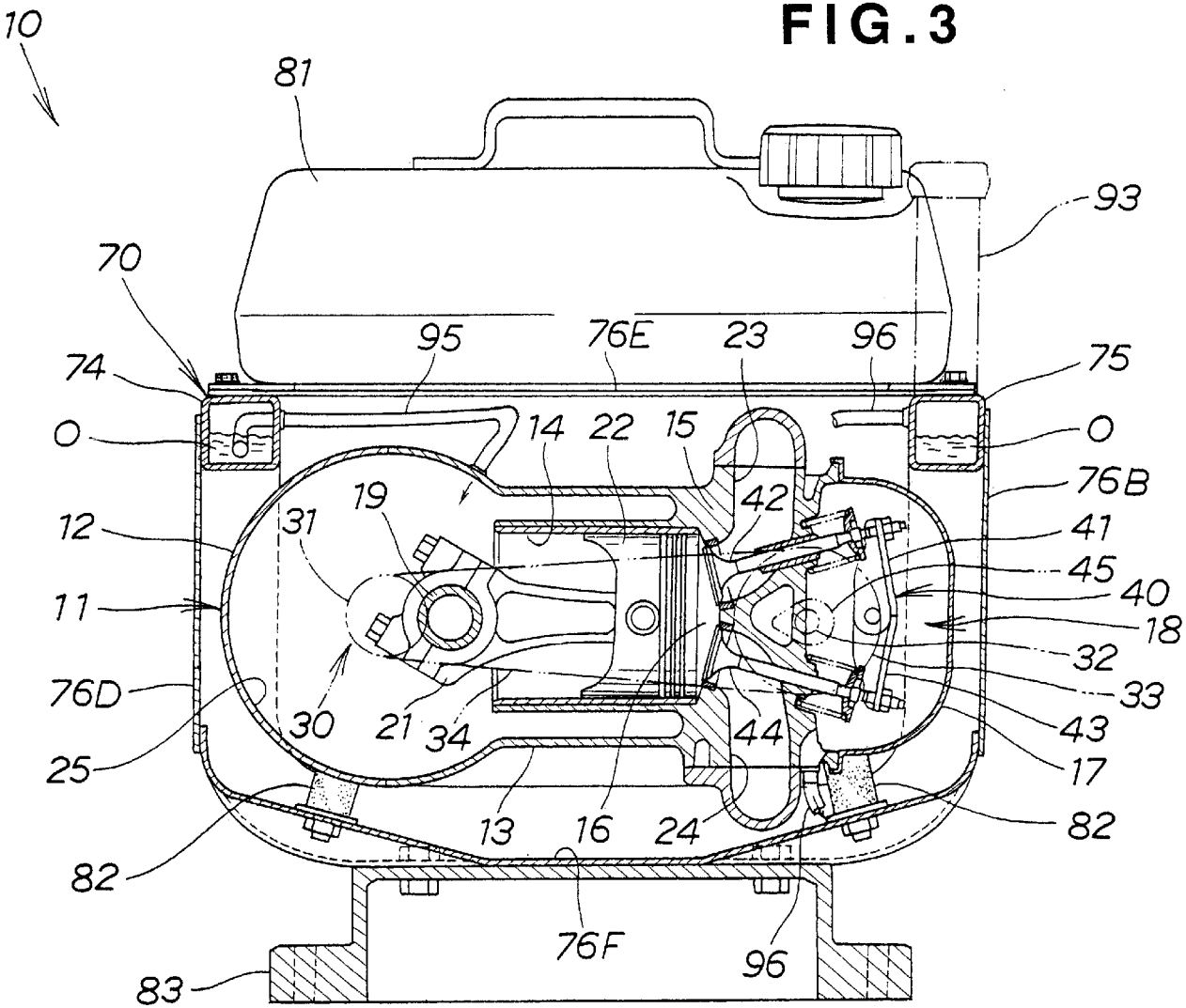
FIG. 3 is a side cross-sectional view of the oil-cooled engine assembly as viewed in the direction of arrow 3 of FIG. 1.

FIG. 3 is a side cross sectional view of the oil-cooled engine assembly according to the present invention and shows the cross-sectional structure of the oil-cooled engine assembly 10 as viewed in a direction of an arrow 3 in FIG. 1.

The cylinder block 13 has the cylinder head 15 formed with an air intake port 23 and an exhaust port 24.

The valve actuating mechanism 40 is constructed of major component parts including a cam shaft 32, an intake-valve rocker arm 41 and an intake valve 42, an exhaust-valve rocker arm 43 and an exhaust valve 44. Mounting angles of the intake valve 42 and the exhaust valve 44, which extend toward the combustion chamber 16, are designed to have relatively small angles. Accordingly, a single piece of cam 45 suffices to be mounted to a cam shaft 35. Thus, it is possible for the valve actuating mechanism 40 to obtain a low noise and miniaturization with light weight.

FIG. 3 shows a structure wherein a lower part of the crank case 12 and a lower part of the cylinder head 15 of the engine 11 are mounted to the frame body 70 via vibration-free rubbers 82, 82 (by a rubber-mount) and a lower part of the frame body 70 is fixed to a mount base 83 by bolts, if desired.

Thus, the presence of the engine support structure formed with a vibration-free support structure using the rubber mount and the presence of the power output shaft 62 connected to the crank shaft 19 via the displacement absorbing coupling 55 as seen in FIG. 2 interrupt noise and vibration, resulting in the engine assembly 10 with low noise and low vibration. Especially, the engine 11 is of the high speed type and may produce vibration at a relatively high frequency. It is relatively easy for interrupting high frequency vibration with the rubber mount and the displacement absorbing coupling 55. Consequently, such a vibration-free support structure is highly effective in a noise and vibration interrupting performance.

As now apparent from the foregoing description that, as shown in FIGS. 2 and 3, a miniaturization and low noise of the engine 11 can be realized by: (1) the presence of spherical shape, formed in the crank case 12 and the cylinder block 13, which eliminates radiated sound; (2) the presence of the cylinder head 15 unitarily formed at the distal ends of the cylinder block; (3) the presence of the cooling fan 53 and the first coupling member 56, located outside the crank case 12, which play the counter-weight roll; (4) the presence of the crank shaft 19 which is hollowed; (5) the presence of the power transmission mechanism 30 and the valve actuating mechanism 40 with low noise and the miniaturization with low weight; and (6) the presence of the engine support structure and the displacement absorbing coupling 55 which interrupt engine noise and vibration.

Figure 4:
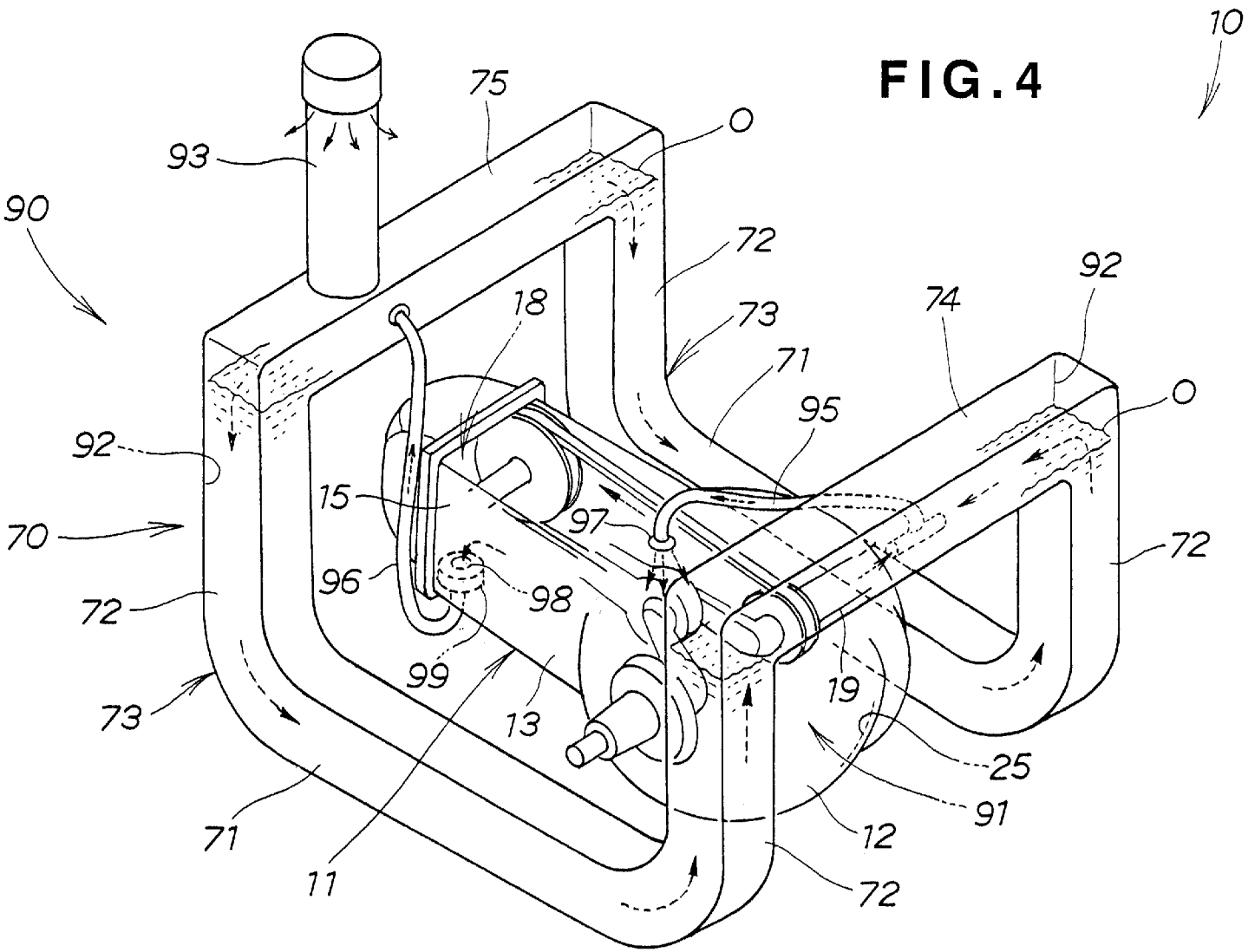
FIG. 4 is a perspective view illustrating a relationship between an engine and a frame body shown in FIG. 1.

FIG. 4 is a perspective view of a major part of the oil-cooled engine assembly according to the present invention, and illustrates a lubricating oil circulation system 90 of the engine 11 and the frame body 70.

The lubricating oil circulation system 90 is arranged to cool lubricating oil, which has lubricated movable parts of the engine 11, and circulate lubricating oil again to the movable parts. In particular, the lubricating oil circulation system 90 features the provision of a lubricating oil pump 91 contained in the engine 11 and an oil passage 92, formed inside the frame body 70 to pass lubricating oil O, which is connected to the lubricating oil pump 91, whereby lubricating oil O, cooled with air at the frame body 70, is circulated to the movable parts of the engine. The lubricating oil circulation system 90 is described below in detail.

The frame body 70 includes frame components 73, 73 and the first and second connecting portions 74, 75 which are internally and entirely communicated with one another to form the oil passage 92 through which lubricating oil O flows.

An upper surface of a longitudinal intermediate portion of the second connecting portion 75 is mounted with a bleeder 93.

The lubricating oil circulation system 90 includes a lubricating oil supply conduit 95 for supplying lubricating oil O, remaining in the frame body 70 in the vicinity of the crank chamber 25 of the engine 11, to the lubricating oil pump 91, and a lubricating oil return conduit 96 through which lubricating oil O is returned from the movable parts of the engine 11 to the frame body 70 at a side closer to the carburetor 51 (see FIG. 2).

Lubricating oil O, which is cooled with the frame body 70, is supplied from the frame body 70 at a side in the vicinity of the crank chamber 25, which remains at a lower temperature than that of the side of the frame body 70 closer to the muffler 52 (see FIG. 2), to the lubricating pump 91. Upon lubrication of the movable parts of the engine, lubricating oil O is returned to the side of the frame body 70 at the side thereof closer to the carburetor 51 which remains at the lower temperature than the side of the frame body 70 closer to the muffler 52. In such a manner, a circulation line of lubricating oil O is separate from the high temperature muffler 52, providing no fear that lubricating oil O is heated with heat of the muffler 52. Accordingly, a cooling efficiency for the movable parts of the engine is highly improved.

More particularly, plumbing is carried out in two methods (1) and (2).

(1) The lubricating oil supply conduit 95 is so connected as to as to supply lubricating oil O from a longitudinal intermediate portion of the first connecting portion 74 to the cylinder block 13, i.e., to the lubricating pump 91 contained in the engine 11.

(2) The lubricating oil return conduit 96 is so connected as to return lubricating oil O from the valve actuating chamber 18 to the longitudinal intermediate portion of the second connecting portion 75.

Figure 5:
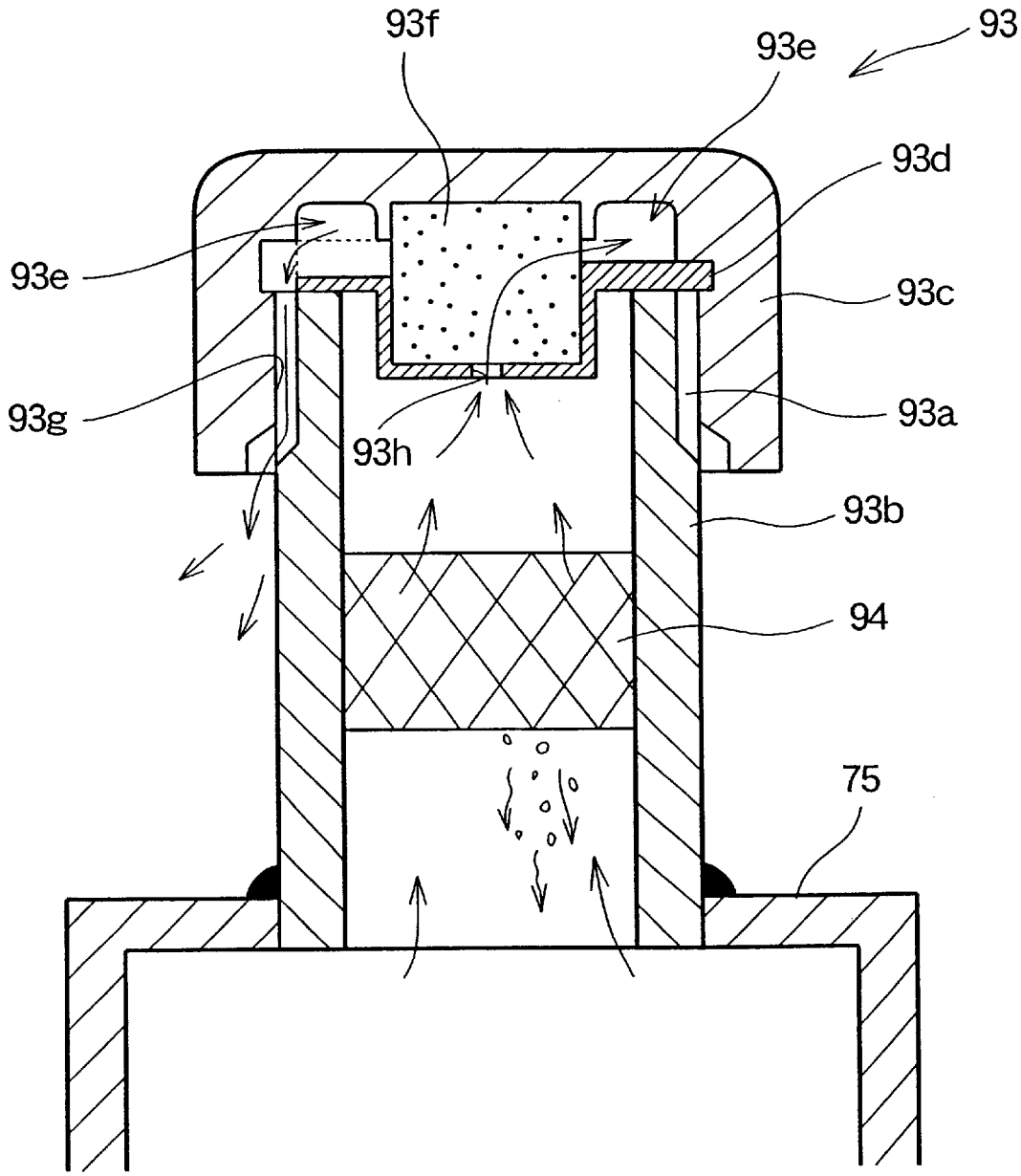
FIG. 5 is an enlarged cross-sectional view of a bleeder shown in FIG. 4.

FIG. 5 is a cross sectional view of the bleeder according to the present invention.

The bleeder 93 includes a bleeder pipe 93*b* which extends upright from the second connecting portion 75 and has an upper circumferential periphery formed with threads 93*a*, a cap 93*c* screwed into the threads 93*a* to close an upper opening of the bleeder pipe 93*b*, a partition member 93*d* which divides an upper end of the bleeder pipe 93*b* and an inside of the cap 93*c*, a space area 93*e* formed between the inside of the cap 93*c* and the partition member 93*d*, a filter 93*f* filled in the space area 93*e*, and a communication recess 93*g* formed at an inner circumferential periphery of the cap 93*c* to communicate with the space area 93*e* and the atmosphere.

The partition member 93*d* is composed of a packing having a communication aperture 93*h* which communicates with the bleeder pipe 93*b* and the space area 93*e* via the filter 93*f*. The filter 93*f* serves to separate lubricating oil mist from air and interrupt the entry of dusts from outside and is composed of, for example, a sponge.

Such a bleeder 93 includes an air-liquid separator 94 located in the bleeder pipe 93*b*. The air-liquid separator 94 serves to separate lubricating oil mist into oil droplets and of lubricating oil and air to allow lubricating oil to return to the second connecting portion 75 while discharging only air to the atmosphere.

Lubricating oil mist contained in the second connecting portion 75 is thus separated into oil mist of lubricating oil and air. Oil droplet thus separated falls into the second connecting portion 75. Separated air is discharged to the atmosphere along a path including the communication aperture 93*h* the filter 93*f* the space area 93*e* the communication recess 93*g*.

Figure 6A:
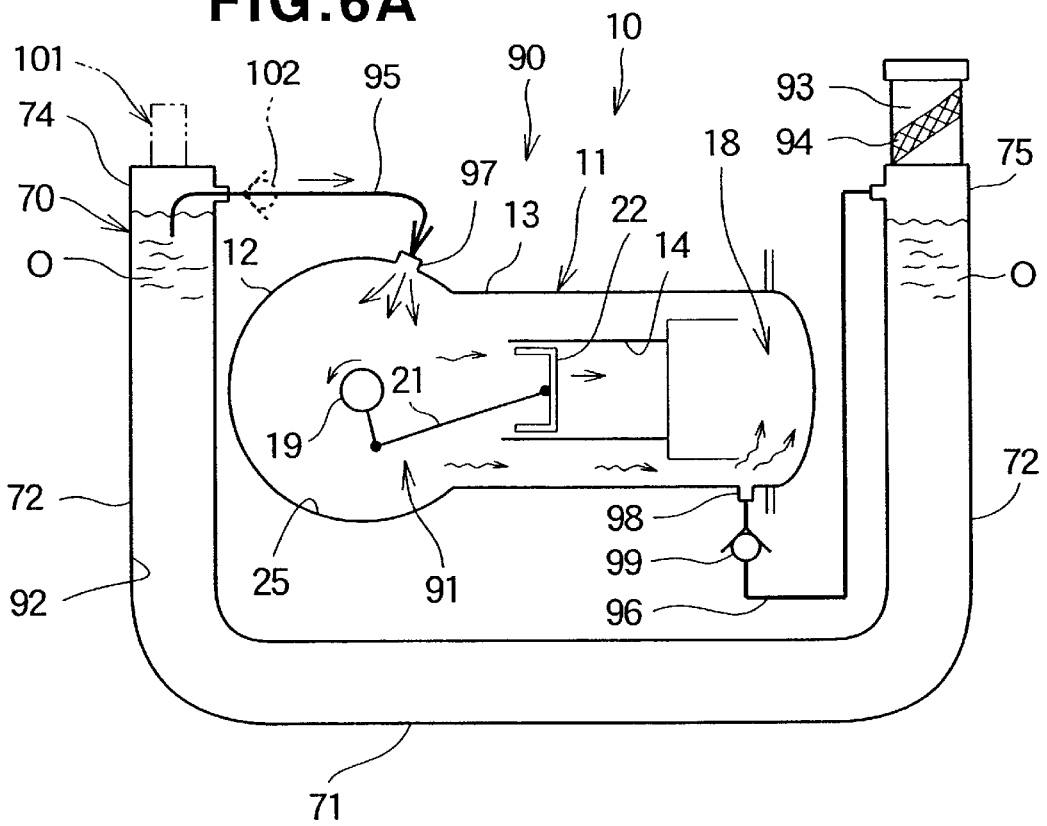
FIGS. 6A and 6B are schematic views illustration an operation of a lubricating oil supply system according to the present invention.
Figure 6B:
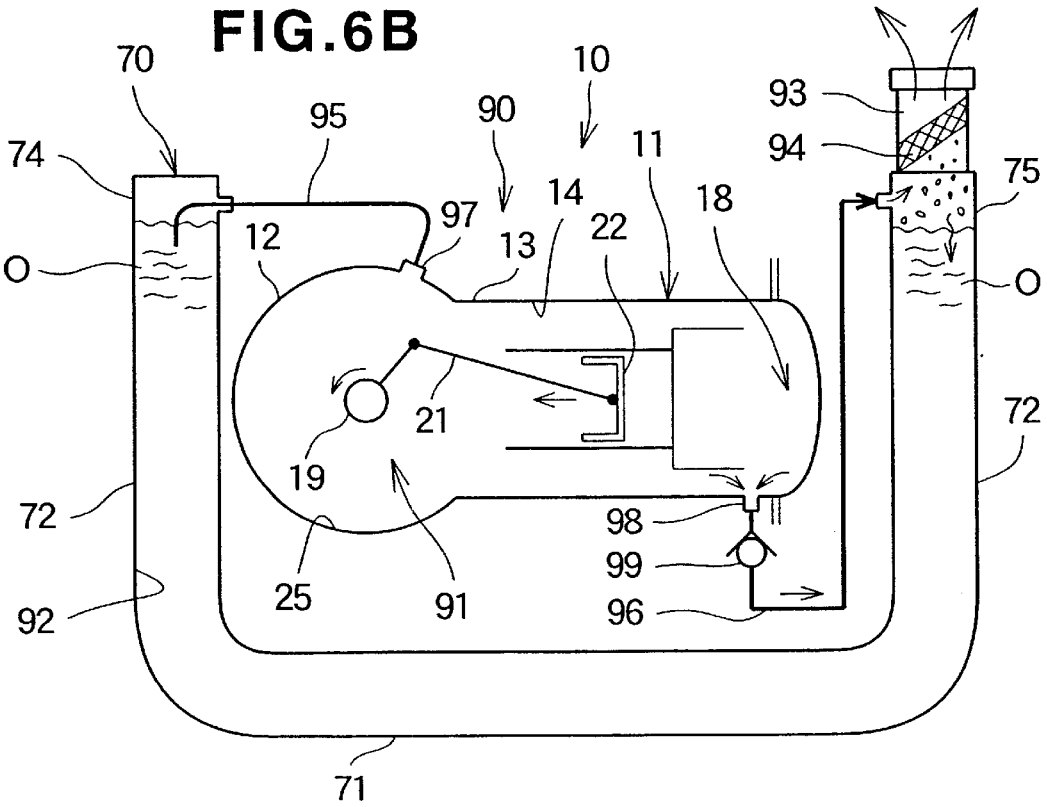

FIGS. 6A and 6B are operational views illustrating how lubricating oil is circulated in accordance with the present invention.

In FIG. 6A, the frame body 70 is filled at upper areas of the first and second connecting portions 74, 75 with lubricating oil O to serve as an oil tank.

The lubricating oil supply conduit 95 is made of a pipe or a hose whose one end is inserted inside the first connecting pipe 74 and is put into lubricating oil O to perform liquid seal and the other end is connected to a supply port 97 of the cylinder block 13.

The lubricating oil return conduit 96 is made of a pipe or a hose whose one end is connected to a discharge port 98 of the valve actuating chamber 18 and the other end is connected to an inside of the second connecting portion 75. Such a lubricating oil return conduit 96 includes a check valve (one-way valve) 99. The check valve 99 is opened only when the pressure in the valve actuating chamber 18 exceeds beyond a given level which is preliminarily determined.

Also, a bleeder 101, shown by a phantom line, is preferably mounted at the upper surface of the first connecting portion 74 to provide a communication between the oil passage 92 and the atmosphere. In addition, the lubricating oil supply pipe 95 may further be preferably located with a check valve 102 which is arranged to open only when intake pressure in the crank chamber 25 decreases below a given level which is preliminarily determined.

The engine 11 has the crank chamber 25, formed with the crank case 12 and the cylinder block 13, which accommodates therein the crank shaft 19 and communicates with the valve actuating chamber 18. Since the engine 11 is of the four-cycle type, the piston 22 moves toward right, i.e., in an upward stroke as seen in FIG. 6A during a compression stroke and an exhaust stroke and moves toward left as seen in FIG. 6B, i.e., in a downward stroke during an intake stroke and an explosion stroke.

As viewed in FIG. 6A, the upward movement of the piston 22 causes the pressure in the valve actuating chamber 18 and the crank chamber 25 to become negative pressure. As a result, lubricating oil O in the first connecting member 74 is sucked through the lubricating oil supply conduit 95 into the crank chamber 25 to be injected thereto. Injected lubricating oil O hits an internal wall of the crank chamber 25 to be atomized to form mist. With such lubricating oil mist, lubrication is carried out in the movable parts (the crank shaft 19, the connecting rod 21, the piston 22 and various movable parts of the power transmission mechanism 30 and the valve actuating mechanism 40 shown in FIG. 2) of the engine 11. When this occurs, further, the check valve 99 remains unopened.

As viewed in FIG. 6B, the downward movement of the piston 22 causes the pressure in the valve actuating chamber 18 and the crank chamber 25 to be increased. This results in interruption of the sucking operation of lubricating oil O that would occur from the first connecting portion 74 to the crank chamber 25. On the other hand, since the pressure in the crank chamber 25 exceeds the predetermined pressure level, the check valve 99 is opened. As a consequence, lubricating oil mist in the valve actuating chamber 18 and the crank chamber 25 is returned through the lubricating oil return conduit 96 to the second connecting portion 75. Lubricating oil mist, thus returned, is then separated with the air-liquid separator 94 into lubricating oil droplets and air, with only lubricating oil being stored in the frame body 70. The presence of the oil passage 92 formed inside the frame body 70 to flow lubricating oil O allows lubricating oil O to be cooled with air. Thus, the frame body 70 plays a role as an oil cooler.

As apparent from the foregoing description, since the engine 11 plays a role to circulate lubricating oil in the frame body 70 by pumping operation, it is said that the engine 11 has a structure containing the lubricating pump 91. The presence of the lubricating oil 91 contained in the engine 11 preclude the lubricating pump 91 from protruding from the engine 11.

Further, the presence of the frame body 70, which supports the engine 11, arranged to surround the engine 11 and the engine accessories 51, 52 (see FIG. 1) allows the frame body 70 to have an increased total length. Since the hollow frame body 70 is adopted, the frame body 70 is used as the oil passage 92 through which lubricating oil O flows, thereby enabling lubricating oil O to be cooled with air. The presence of the increased total length of the frame body 70 provides an increased heat dissipating surface area. This results in an increased heat dissipating effect. Thus, the frame body 70, which supports the engine 11, plays a role as the oil cooler.

Further, the presence of flow of lubricating oil through the oil passage 92 in the frame body 70 allows the frame body 70 to serve as the oil tank which stores lubricating oil O. Since the frame body has the increased total length, the frame body 70 has a large capacity for storing lubricating oil.

Accordingly, there is no need for additionally providing the oil cooler and the oil tank, with a resultant miniaturization in the overall structure of the oil-cooled engine assembly 10.

Figure 7A:
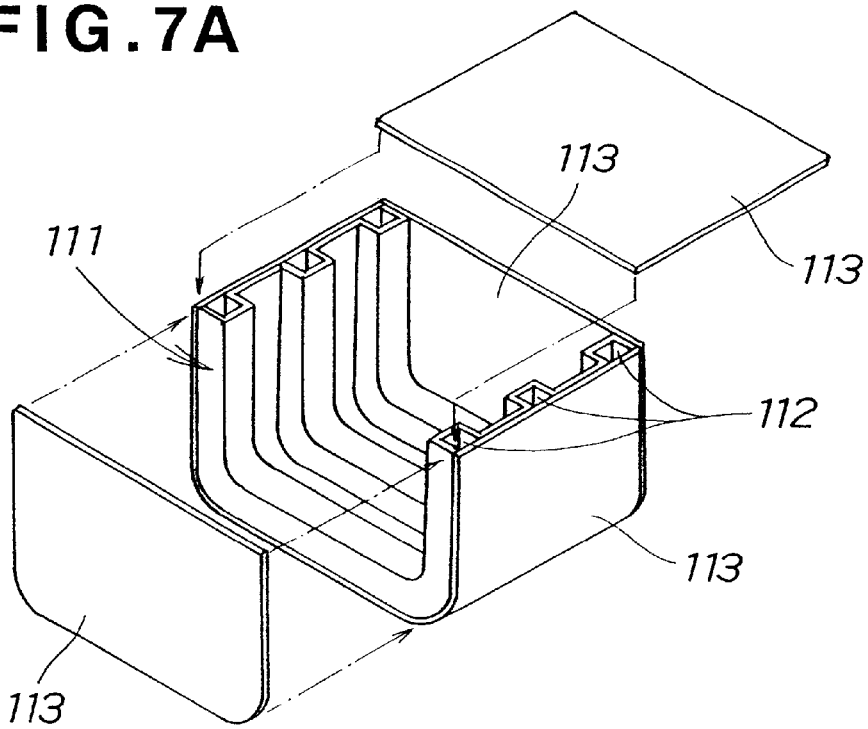
FIGS. 7A and 7B are perspective views illustrating first and second modified forms of the frame body and the cover plates shown in FIG. 1.
Figure 7B:
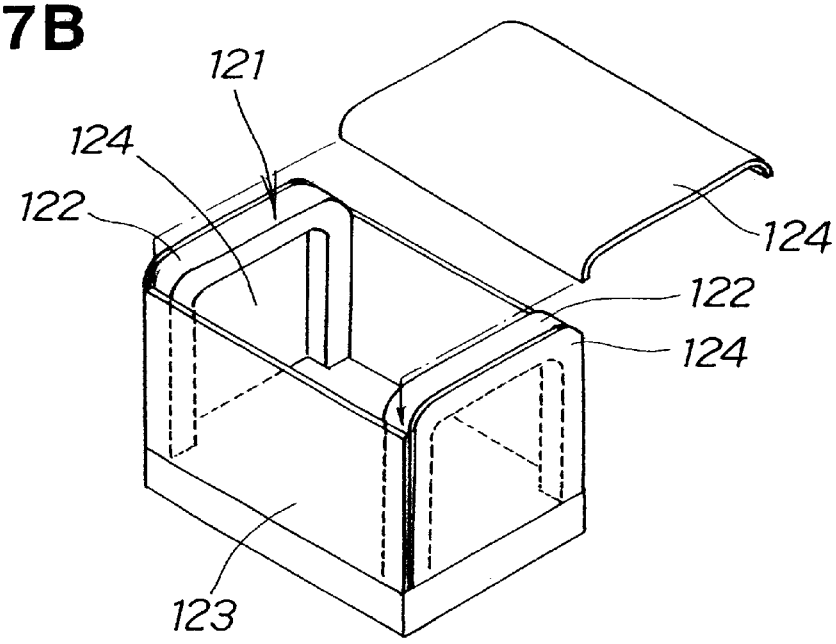

FIGS. 7A and 7B show modified forms of the frame body and the cover plates in accordance with the present invention.

FIG. 7A illustrates a frame body 111 of a first modified form. The frame body 111 of the first modified form is a U-shaped hollow frame, as viewed from a side, having a plurality of oil passages 112 located in a given pitch, and is made of extrusion material of aluminum alloy. A circumferential periphery of the frame body 111 is covered with a plurality of cover plates 113. Such a frame body 111 is enabled to cover the engine 11 and the engine accessories 51, 52 shown in FIG. 1 and to support the engine 11. In addition, an inner part of the frame body 111 is formed with the plurality of oil passages 112 through which lubricating oil O flows, rendering the plurality of oil passages 112 to serve as the oil cooler and the oil tank.

FIG. 7B shows a frame body 121 of a second modified form. The frame body 121 of the second modified form is composed of a structure including a plurality of reversed U-shaped hollow frame sections 122 with respective lower ends joined to a flat-shaped tank 123, with peripheries of the hollow frame sections 122 being covered with a plurality of cover plates 124. Such a frame body 121 is enabled to surround the engine 11 and the engine accessories 51, 52 and to support the engine 11. In addition, inner parts of the plurality of hollow frame sections 122 are formed with oil passages, respectively, through which lubricating oil flows, with the oil passages being in communication with the tank 123. Thus, the oil passages and the oil tank 123 are rendered to serve as the oil cooler and the oil tank.

In the aforementioned preferred embodiments of the present invention, the frame body 70 may be composed of hollow members and takes arbitrary cross sectional shapes, materials and dimensions in structure.

The lubricating pump 91 may be of any structure which is contained in the engine 11, and is not intended to be limited to a particular structure of the type having the pumping function. For example, the lubricating pump 91 may be composed of an independent pump which is driven with the crank shaft.

In addition, the power output shaft 62 may be of the type which can be detachably connected to the crank shaft 19 and may be connected directly to the crank shaft 19 without through the displacement absorbing coupling 55 or the reduction gear mechanism 61. Also, the power output shaft 62 may be of the type which is rotatably supported with the body frame 70 or the plurality of cover plates 76A to 76F arbitrarily via the gear case 66.

The present disclosure relates to the subject matter of Japanese Patent Application No. 2000-344469, filed Nov. 10, 2000, the disclosure of which is incorporated herein by reference in its entirety.

What is claimed is:

1. An oil-cooled engine assembly comprising:

an engine;

a lubricating oil pump disposed within the engine;

a hollow frame body which surrounds the engine and engine accessories including a carburetor and a muffler, supports the engine, and is internally formed with an oil passage through which a lubricating oil flows;

a plurality of cover plates covering the frame body, one of the cover plates having an intake port; and a cooling fan mounted to a crank shaft of the engine for drawing in outside air through the intake port;

the lubricating oil pump being connected to the oil passage so that after lubricating movable parts of the engine, the lubricating oil is air cooled by the frame body and then returned to circulation for lubricating the movable parts of the engine again.

2. An engine assembly according to claim 1; wherein the carburetor is located at one side of the engine and the muffler is located at the other side of the engine, and further comprising a lubricating oil supply conduit for supplying the lubricating oil from a frame body component of the frame body, in the vicinity of a crank chamber of the engine, to the lubricating oil pump.

3. An engine assembly according to claim 2; further comprising a lubricating oil return conduit for returning the lubricating oil from the movable parts of the engine to a frame body component of the frame body at a side of the carburetor.

4. An engine assembly according to claim 1; wherein a power output shaft is detachably mounted to the crank shaft of the engine and is rotatably supported with either one of the frame body and the cover plates.

5. An oil-cooled engine assembly, comprising:

an engine having movable parts that require lubrication during use of the engine; a hollow frame body supporting therewithin the engine and defining inside thereof an oil passage for storing and flowing a lubricating oil; a lubricating oil pump disposed within and driven by the engine, the lubricating oil pump being connected to the oil passage for circulating the lubricating oil from the engine through the oil passage and then back to the engine to thereby lubricate the movable parts of the engine accompanied by heating of the lubricating oil which, in turn, heats the frame body; and a plurality of cover plates covering the frame body for dissipating heat from the frame body and thus from the lubricating oil while the lubricating oil circulates through the oil passage.

6. An oil-cooled engine assembly according to claim 5; wherein one of the cover plates has an intake port open to outside air; and further comprising a cooling fan disposed within the frame body and driven by the engine to draw in outside air through the intake port.

7. An oil-cooled engine assembly according to claim 5; wherein the engine has a cylinder block having opposed ends, a cylinder head having a head cover connected to one end of the cylinder block, and a crank case connected to the other end of the cylinder block; and further comprising a lubricating oil supply conduit connecting the crank case to the oil passage at a first location; and a lubricating oil return conduit connecting the head cover to the oil passage at a second location.

8. An oil-cooled engine assembly according to claim 7; wherein the engine has a carburetor, the carburetor being positioned closer to the second location than to the first location.

9. An oil-cooled engine assembly according to claim 5; wherein the cover plates each have a generally rectangular shape.

10. An oil-cooled engine assembly according to claim 5; wherein the hollow frame body has a plurality of U-shaped hollow frames defining inside thereof the oil passage.

11. An oil-cooled engine assembly according to claim 5; wherein the hollow frame body has two spaced-apart U-shaped portions interconnected at upper ends thereof by two horizontal portions.

12. An oil-cooled engine assembly according to claim 5; wherein the cover plates are made of aluminum or aluminum alloy.

13. An oil-cooled engine assembly according to claim 5; wherein the hollow frame body is made of aluminum or aluminum alloy.

* * * * *